United States Patent [19]

Payne III

[11] Patent Number: 5,058,521

[45] Date of Patent: Oct. 22, 1991

[54] SUBMARINE WITH KEEL WING FOR EFFECTIVELY COUNTERING TENDENCY TO SNAP ROLL IN HIGH SPEED TURNS WHILE FULLY SUBMERGED

[75] Inventor: Henry E. Payne III, Palm Bay, Fla.

[73] Assignee: Payne Engineering Company, Scott Depot, W. Va.

[21] Appl. No.: 590,057

[22] Filed: Sep. 28, 1990

Related U.S. Application Data

[63] Continuation of Ser. No. 356,887, May 25, 1989, abandoned.

[51] Int. Cl.[5] ..... B63G 8/06

[52] U.S. Cl. ..... 114/339; 114/152; 114/163; 114/332

[58] Field of Search ..... 114/312, 332, 163, 167, 114/339, 340, 152, 333, 313, 248, 249

[56] References Cited

U.S. PATENT DOCUMENTS

| | | | |
|---|---|---|---|
| 540,105 | 5/1885 | Lacavalerie | 114/152 |
| 746,606 | 12/1903 | Toomey . | |
| 1,061,826 | 5/1913 | Didlake . | |
| 1,072,393 | 9/1913 | Spear et al. | 114/340 |
| 1,771,093 | 7/1930 | Mayers | 114/340 |
| 2,377,442 | 6/1945 | Osterhoudt | 114/332 |
| 2,859,721 | 11/1958 | Endrezze | 114/312 |
| 2,972,324 | 2/1961 | Williams | 114/163 |
| 2,980,047 | 4/1961 | Korganoff et al. . | |
| 3,080,845 | 3/1963 | Pollak . | |
| 3,797,433 | 3/1974 | Schirtzinge | 114/122 |
| 4,089,286 | 5/1978 | Scheel . | |
| 4,280,433 | 7/1981 | Haddock . | |
| 4,376,416 | 3/1983 | Carver . | |
| 4,382,419 | 5/1983 | van Drimmelen et al. . | |
| 4,421,050 | 12/1983 | Weinert | 114/248 |
| 4,611,551 | 9/1986 | Ferguson et al. | 114/339 |
| 4,686,923 | 8/1987 | Greene . | |

FOREIGN PATENT DOCUMENTS

| | | | |
|---|---|---|---|
| 335692 | 4/1921 | Fed. Rep. of Germany . | |
| 342456 | 9/1904 | France | 114/312 |
| 1228584 | 5/1959 | France | 114/312 |
| 300377 | 9/1965 | Netherlands . | |
| 174018 | 1/1922 | United Kingdom | 114/167 |

OTHER PUBLICATIONS

Malloy, Joseph D., Aircraft Techniques Applied to Submarines, IAS Paper No. 61–42, New York, NY., 1961, Title Page and 1 Sheet of drawing.

*Primary Examiner*—Sherman D. Basinger
*Assistant Examiner*—Thomas J. Brahan
*Attorney, Agent, or Firm*—Cushman, Darby & Cushman

[57] ABSTRACT

A submarine hull which has a half wing-like sail which projects vertically upwards, is provided with a keel-wing that also is half wing-like, but projects vertically downwards. By preference the keel-wing has a lower end plate and its main portion is trailed by two slotted flaps which can be pivotally moved in both directions about respective vertical axes in coordination with movement of the rudder of the submarine. If needed for permitting operation in shallow water or with the hull close to the bottom, the wing can be made to retract. The keel-wing not only counters the sail's rolling movement and keeps the hull upright, but also adds a side force to assist in tightening the turn.

14 Claims, 4 Drawing Sheets

SUBMARINE WITH KEEL WING FOR EFFECTIVELY COUNTERING TENDENCY TO SNAP ROLL IN HIGH SPEED TURNS WHILE FULLY SUBMERGED

This is a continuation of application of Ser. No. 07/356,887, filed on May 25, 1989, which was abandoned.

BACKGROUND OF THE INVENTION

FIGS. 1A and B show side by side for comparison, diagrams of forces acting on a modern fighter airplane in a steep turn, and forces acting on a modern submarine executing a fast turn while fully submerged.

Referring first to FIG. 1A, as the fighter plane executes a steep turn, its two half wings pull together to offset the centrifugal force that is tending to pull the plane out of the turn.

Referring for contrast to FIG. 1B, a conventional modern submarine has only one half wing, namely its sail (or conning tower), for offsetting the centrifugal force in a turn. As a result, a convention submarine tends to roll in a turn, and tends to snap roll if a high speed turn is attempted.

FIG. 2 shows a computer simulation of the vortex flow field on a modern submarine hull that is yawed towards the viewer approximately 15 degrees. The sail 22 of a modern attack submarine 10 typically measures 400 to 500 square feet in size and, acting like a lifting wing on its side, generates a side force which is nearly half as large as that created by the two hull vortices 12, 12 that start at the bow and roll upon the lee side of the yawing body of revolution. This side force, centered well above the center of gravity of the submerged submarine, is the cause of the snap roll problem which has prevented routine, high-speed turning maneuvers by modern submarines.

SUMMARY OF THE INVENTION

A submarine hull which has a half wing-like sail which projects vertically upwards, is provided with a keel-wing that also is half wing-like, but projects vertically downwards. By preference the keel-wing has a lower end plate and its main portion is trailed by two slotted flaps which can be pivotally moved in both directions about respective vertical axes in coordination with movement of the rudder of the submarine. If needed for permitting operation in shallow water or with the hull close to the bottom, the wing can be made to retract. The keel-wing not only counters the sail's rolling movement and keeps the hull upright, but also adds a side force to assist in tightening the turn.

The principles of the invention will be further discussed with reference to the drawings wherein a preferred embodiment is shown. The specifics illustrated in the drawings are intended to exemplify, rather than limit, aspects of the invention as defined in the claims.

Figure 1A:
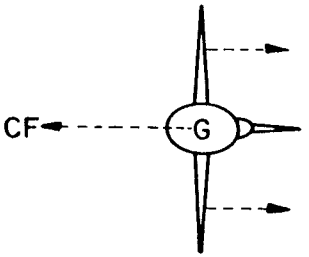
FIG. 1A (PRIOR ART)
FIG. 1A is a schematic diagram of a modern fighter plane executing a steep turn.
Figure 1B:
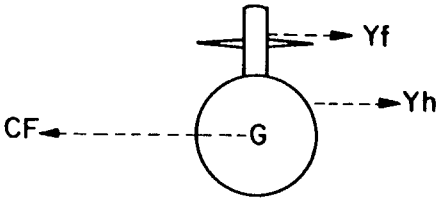
FIG. 1B (PRIOR ART)
FIG. 1B is a schematic diagram of a modern submarine upon executing a turn.
Figure 2:
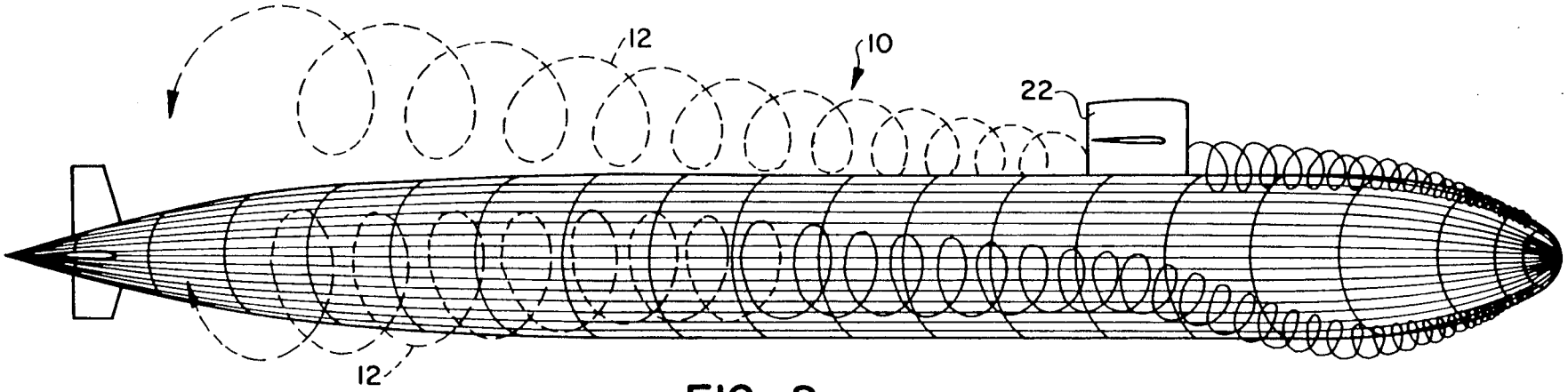
FIG. 2 (PRIOR ART)
FIG. 2 is a computer simulation of the vortex flow field on a modern submarine hull that is yawed towards the viewer approximately 15 degrees.

DETAILED DESCRIPTION (FIGS. 1A, 1B and 2 have already been discussed in the Background section of this document.)

Figure 3:
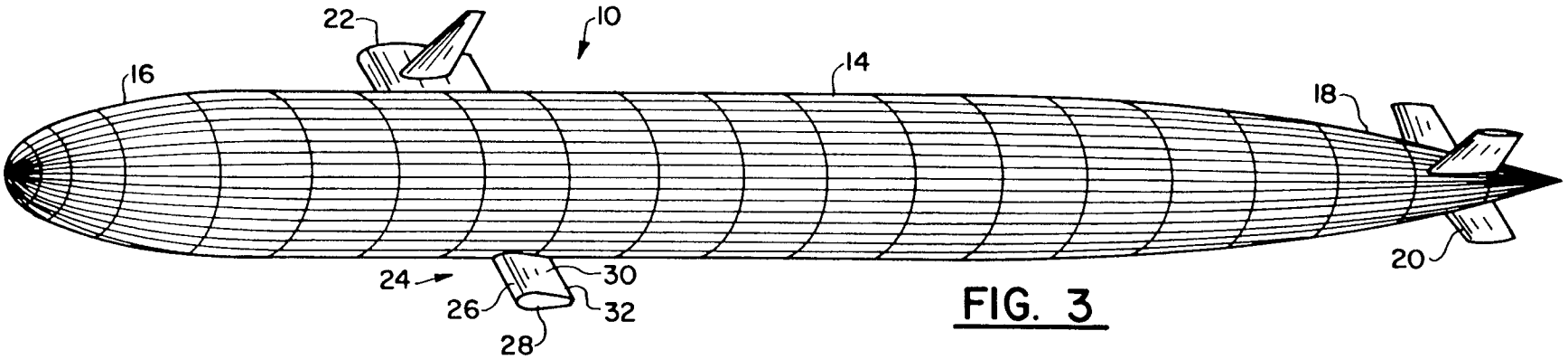
FIG. 3 is a perspective view from below, of a modern submarine equipped with a keel-wing in accordance with principles of the present invention.

FIG. 3 shows in perspective, from somewhat below, a modern submarine 10 equipped with a keel-wing according to principles of the present invention. The submarine 10 may be otherwise conventional. For instance, the submarine 10 includes a substantially cigar-shaped (substantially circular cross-sectioned) hull 14 with a blunt nose or bow 16 and a conically tapered tail or stern 18.

The stern is shown provided with a set of rudders, including a rudder 20 which projects vertically downwards from the hull when the submarine is oriented right-side up and level.

Figure 4:
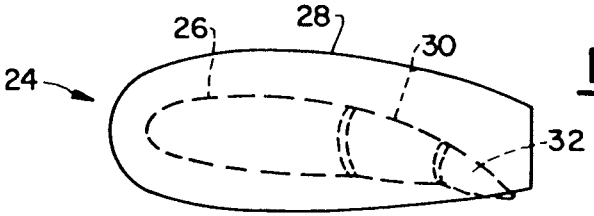
FIG. 4 is a bottom plan view of the keel-wing thereof.

In operation, the rudder 20 is pivoted leftwards and rightwards for laterally steering the submarine, e.g. for executing left and right turning movements about an imaginary vertical centerline plane of the hull. The prior art contains information as to ways and means for controlling rudder pivoting. For instance, see FIG. 4 and the description relating thereto in Malloy, Aircraft Techniques Applied to Submarines, Institute of the Aerospace Sciences paper No. 61-42 (1961).

About thirty percent of the distance from the bow towards the stern, the hull 14 is shown conventionally provided with a conning tower or sail 22, which projects vertically upwards from a location on the vertical centerline plane of the hull when the submarine is oriented right side up and level.

A keel-wing 24 is provided for the submarine 10 in accordance with the principles of the present invention. Its position and construction are preferably as indicated in FIGS. 3–8.

The keel-wing 24 is shown resembling a multiple-element airfoil (i.e., resembling aircraft wing which has a stationary main portion and a series of two trailing flap portions which can progressively pivot). The base of the stationary main portion 26 (i.e. its upper end) may be fixed to the submarine in the same manner as the sail, but disposed so that the keel-wing projects in an opposite direction to the sail. That is, the keel-wing has its base upwards and projects vertically downwards. The lower free end of the keel-wing is preferably provided with an end plate 28 provided in analogous relation to the end plates of the rear wings of Formula I and Indy 500 race cars. The series of trailing elements 30, 32 may be movably mounted to the hull and/or to the end plate 28. Their leftward, rightward progressive pivotability about vertical axes is shown provided by an actuator 34 which is rotatably mounted to the main portion 26 and connected to the trailing elements 30, 32, by a linkage system 36. As the actuator 34 is rotated clockwise and counterclockwise, the linkage system 36 progressively pivots the trailing elements 30, 32 of the keel-wing leftwards and rightwards. For smooth operation, the linkage system 36 may be duplicated one or more times at various levels along the height of the keel-wing, each such replication of the linkage system being mounted to the actuator 34 for movement thereby.

By preference, the actuator 34 is incorporated in the control system for the rudder 20, so that the trailing elements are pivoted coordinately with the rudder.

The shape of the keel-wing and the size and shape of the end plate relative to the wing portion are preferably as shown. The keel-wing can be as small as one-third to one-quarter the size of the sail 22.

The flap segments 30, 32 of the keel-wing can be hydraulically linked to the hydraulics of the rudder control system at a desired ratio for maintaining the hull acceptably upright throughout a turn made at a design speed and radius.

In one elaboration upon the system, the keel-wing could be made to fold into a bay provided for it in the underside of the hull, in order to permit the hull to descend closer to the bottom of a body of water and/or to permit the submarine to berth in a shallower port. In a further elaboration, the trailing part of the sail itself could be provided with flaps similar to the flaps 30, 32, and controlled in the same manner to move coordinately with the rudder.

Figure 6:
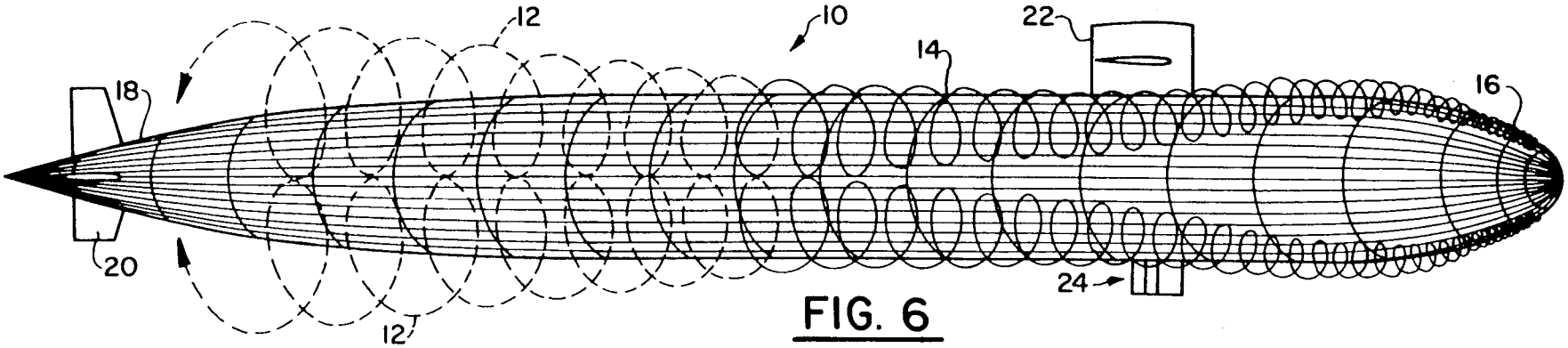
FIG. 6 (provided for comparison with FIG. 2) is a computer simulation of the vortex flow field on a modern submarine equipped with a keel-wing in accordance with principles of the present invention.
Figure 5:
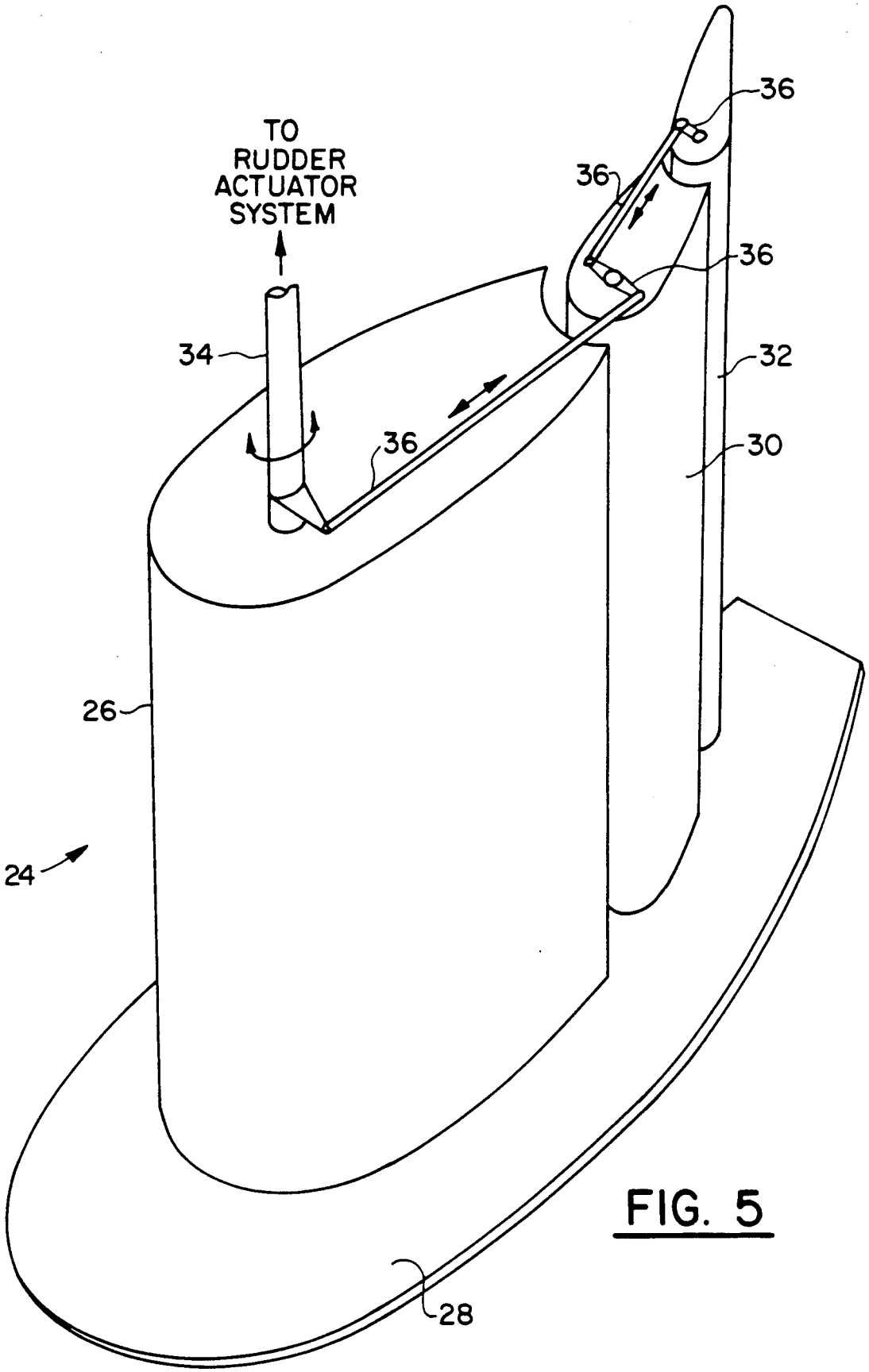
FIG. 5 is a fragmentary perspective view of the keel-wing from above.

FIG. 6 shows, for comparison with FIG. 2, a computerized simulation of the vortex flow field on a modern submarine hull that is yawed towards the viewer about fifteen degrees. The presence of the keel-wing substantially affects the position of the twin vortices.

The side-force generated by the "circulation" from the sail in FIG. 2 shows its influence clearly. By countering this with the equal and opposite side-force "circulation" from the keel-wing, it is possible to contain the twin vortices at the same time that the "snap roll" rolling moment has been negated. (Both the sail and the keel-wing will also generate small "wing-tip" vortices as a result of their side-forces but they are not shown in FIG. 6.)

Containment and control of strong, bow-generated vortices is well known in the aerospace world. In fact, much of the published literature on vortex generation is for aircraft and missiles.

Figure 7:
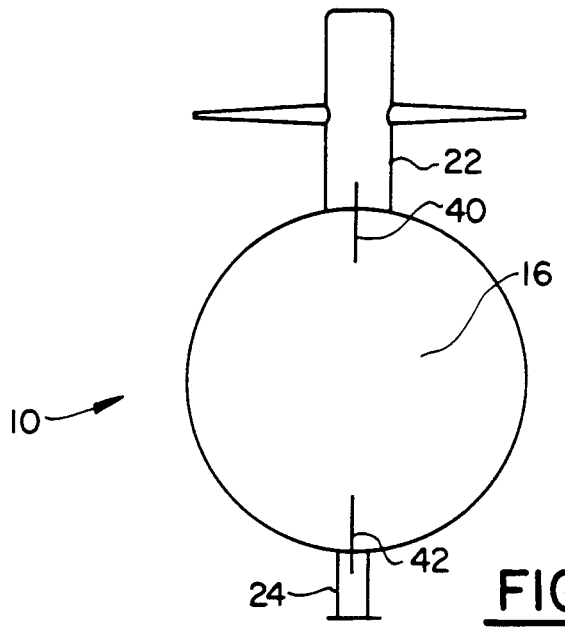
FIG. 7 is a front elevational view of the modern submarine of FIGS. 3–6, further provided with upper and lower simple longitudinal strakes respectively leading to the sail and the keel-wing for promoting earlier and more positive creation of the two vortices shown in FIG. 6.
Figure 8:
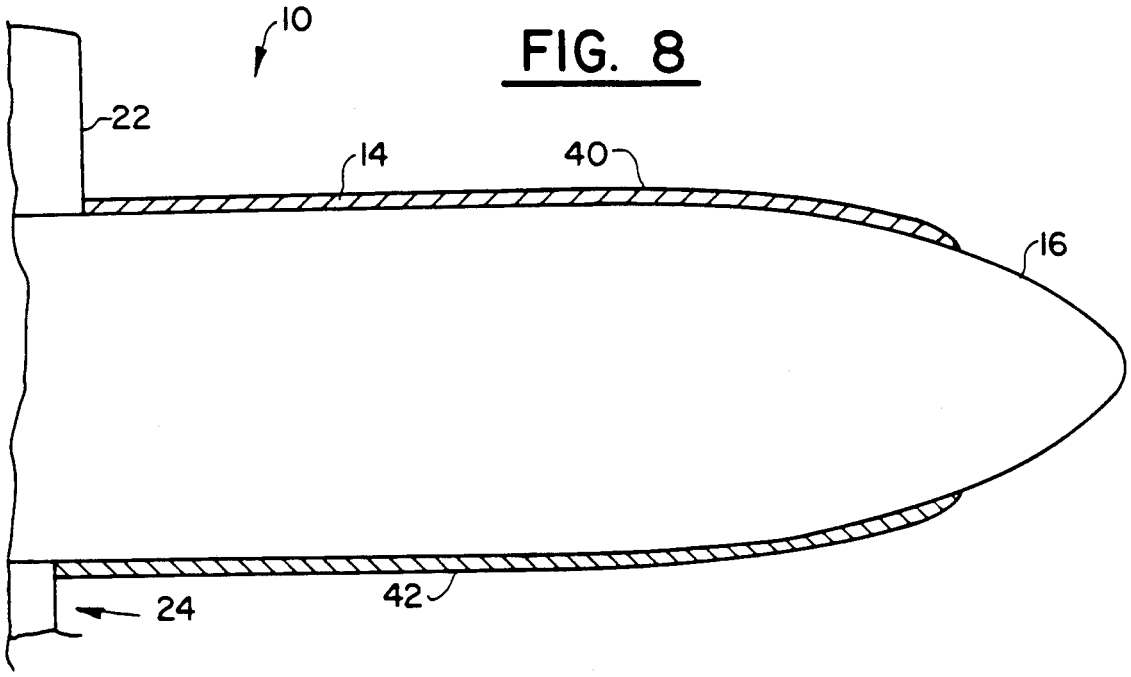
FIG. 8 is a fragmentary side elevation view of the fore portion of the submarine hull of FIG. 7.

A further elaboration of the invention is depicted in FIGS. 7 and 8, in which the submarine 10, provided with the keel-wing 24, is shown further provided with simple longitudinal strakes 40, 42 on the top and bottom of the hull for strengthening and controlling the vortices indicated in FIG. 6. The provision of these strakes will permit the submarine to turn on a smaller radius while completely submerged, without rolling unacceptably. The ability to execute tight turns without rolling unacceptably is believed to represent a significant advance, since it can enable the submarine more effectively to evade torpedoes targeted and launched against it.

Maneuvering any vehicle in a fluid medium, whether it be air or water, requires that the vehicle overcome its own inertia forces as well as the force of the fluid impinging on the hull or rudder, etc. To appreciate the magnitude of these fluid forces, imagine if you will, how the air pressure feels on one's hand out the window of a car travelling at 60 mph. This pressure (engineers call it "q") will be about 10 pounds per square foot.

For a submarine travelling at 20 kts., this pressure will be about 1140 lbs/ft$^2$! Oddly enough, this same 1140 psf pressure is also experienced by an aircraft at Mach 2 and 40,000 feet—or 700 mph at 6,000 feet. To fly and maneuver at these speeds with these forces requires a stable, well-built platform, whether it be an F-4 Phantom fighter or a submarine.

It should now be apparent that the submarine with keel wing for effectively countering tendency to snap roll in high speed turns while fully submerged as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A submarine having a decreased tendency to roll in turns while submerged, comprising:

an elongated hull having a bow, a stern and a generally cylindrical intermediate portion extending between the bow and stern;

said stern being provided with rudder means which can be actuated for steering the hull laterally to the left and to the right relative to an imaginary vertical centerline plane of the hull;

actuator means for actuating said rudder means;

a conning tower externally provided on the top of said hull in said intermediate portion; and keel-wing means for countering a rolling movement caused by said conning tower when the submarine is executing a turn, said keel-wing means being externally provided on the bottom of said hull at least generally opposite said conning tower, and having at least one portion which is pivotable leftwardly and rightwardly about a respective vertical axis, relative to said vertical centerline plane, for movement in a direction effectively opposite to said rudder when said rudder, as actuated by said actuator means is causing the submarine, while submerged and moving forwardly, to execute a turn.

2. The submarine of claim 1, wherein:

said keel-wing means includes a leading portion fixed to said hull and a first trailing portion pivotally mounted in trailing relation to said fixed leading portion for leftward and rightward pivoting relative to said fixed leading portion.

3. The submarine of claim 2, wherein:

said keel-wing means further includes a second trailing portion pivotally mounted in trailing relation to said first trailing portion for further leftward and rightward pivoting relative to said fixed leading portion.

4. The submarine of claim 3, further including:

actuator means for pivoting said first and second trailing portions relative to said fixed leading portion, said actuator means for said first and second trailing portions being operatively connected to said actuator means for said rudder means for coordinating movement of said first and second trailing portions with movement of said rudder.

5. The submarine of claim 3, further comprising:

an end plate provided on said keel-wing means to extend on a horizontal plane below said fixed and trailing portions, said end plate being of greater horizontal extent than the perimeter of said fixed and trailing portions of said keel-wing.

6. The submarine of claim 3, further comprising:

a first longitudinal strake provided on top of said hull on said bow and extending aft substantially to said conning tower; and a second longitudinal strake provided on the bottom of said hull on said bow and extending aft substantially to said fixed portion of said keel-wing means.

7. The submarine of claim 1, wherein:

said intermediate portion of said hull is of substantially circular external transverse cross-sectional shape.

8. The submarine of claim 1, wherein said conning tower is provided with at least one portion which is pivotable leftwardly and rightwardly relative to said vertical centerline plane, for coordinated movement with said keel-wing means.

9. A submarine having a decreased tendency to roll in turns while submerged, comprising:

an elongated hull having a bow, a stern and a generally cylindrical intermediate portion extending between the bow and stern;

said stern being provided with rudder means which can be actuated for steering the hull laterally relative to an imaginary vertical centerline plane of the hull;

actuator means for actuating said rudder mans;

a conning tower externally provided on the top of said hull in said intermediate portion; and keel-wing means for countering a rolling movement caused by said conning tower when the submarine is executing a turn, said keel-wing means externally provided on the bottom of said hull at least generally opposite said conning tower, and having a leading portion fixed to said hull and a first trailing portion and second trailing portion each pivotably mounted in trailing relation to said fixed leading portion for leftward and rightward pivoting relative to said fixed leading portion for movement when said rudder is causing the submarine, while submerged and moving forwardly, to execute a turn;

a first longitudinal strake provided on top of said hull on said bow and extending aft substantially to said conning tower; and a second longitudinal strake provided on a bottom of said hull on said bow and extending aft substantially to said fixed portion of said keel-wing means.

10. The submarine of claim 9, further comprising:

actuator means for pivoting said first and second trailing portions relative to said fixed leading portion, said actuator means for said first and second trailing portions being operatively connected to said actuator means for said rudder means for coordinating movement of said first and second trailing portions with movement of said rudder.

11. The submarine of claim 9, further comprising:

an end-plate provided on said keel-wing means and extending on a horizontal plane below said fixed and trailing portions, said end-plate being of greater horizontal extent than the perimeter of said fixed and trailing portions of said keel-wing means.

12. The submarine of claim 9, wherein:

said intermediate portion of said hull is of substantially circular external transverse cross-sectional shape.

13. The submarine of claim 9, further comprising:

retracting means for retracting said keel-wing means within said hull.

14. The submarine of claim 9, wherein said conning tower is provided with at least one portion which is pivotable leftwardly and rightwardly relative to said vertical centerline plane, for coordinated movement with said keel-wing means.

* * * * *